US007023393B2

(12) United States Patent
Ishii et al.

(10) Patent No.: US 7,023,393 B2
(45) Date of Patent: Apr. 4, 2006

(54) SLOT ARRAY ANTENNA AND PLASMA PROCESSING APPARATUS

(75) Inventors: Nobuo Ishii, Kobe (JP); Makoto Ando, I-312, 1-1, Ogura, Saiwai-ku, Kawasaki-shi, Kanagawa 211-0954 (JP); Masaharu Takahashi, 5-4-12, Midorigaoka, Yachiyo-shi, Chiba 276-0049 (JP)

(73) Assignees: Tokyo Electron Limited, Tokyo (JP); Makoto Ando, Kawasaki (JP); Masaharu Takahashi, Yachiyo (JP)

( * ) Notice: Subject to any disclaimer, the term of this patent is extended or adjusted under 35 U.S.C. 154(b) by 197 days.

(21) Appl. No.: 10/693,912

(22) Filed: Oct. 28, 2003

(65) Prior Publication Data

US 2004/0155829 A1 Aug. 12, 2004

(30) Foreign Application Priority Data

Oct. 29, 2002 (JP) ..... 2002-314623

(51) Int. Cl.
*H01Q 13/10* (2006.01)

(52) U.S. Cl. ..... 343/771; 156/345

(58) Field of Classification Search ..... 343/767, 343/770, 771; 156/345
See application file for complete search history.

(56) References Cited

U.S. PATENT DOCUMENTS

| | | | | |
|---|---|---|---|---|
| 5,579,019 | A | 11/1996 | Uematsu et al. | |
| 6,020,858 | A * | 2/2000 | Sagisaka | 343/771 |
| 6,158,383 | A * | 12/2000 | Watanabe et al. | 118/723 AN |
| 6,343,565 | B1 * | 2/2002 | Hongoh | 118/723 MW |
| 6,372,084 | B1 * | 4/2002 | Hongo et al. | 118/723 ME |
| 6,497,783 | B1 * | 12/2002 | Suzuki et al. | 156/345.34 |
| 6,535,173 | B1 * | 3/2003 | Ou | 343/770 |
| 6,713,968 | B1 * | 3/2004 | Ishii et al. | 315/111.21 |

FOREIGN PATENT DOCUMENTS

| | | |
|---|---|---|
| JP | 53-149752 | 12/1978 |
| JP | 7-106847 | 4/1995 |
| JP | A 2000-123997 | 4/2000 |
| JP | 2000-286631 | 10/2000 |
| JP | 2002-158216 | 5/2002 |

OTHER PUBLICATIONS

English translation of Office Action dated Jan. 4, 2005, issued from the Japanese Patent Office for Japanese Patent Application No. 2002-314623, filed Oct. 29, 2002.

Takahashi et al., "The Suppression of the Reflection by an Inductive Wall of a Power Divider for a Slotted Waveguide Array," The Institute of Electronics Information and Communication Engineers, Technical Report of IEICE, A-P94-7 (1994) pp. 45-50.

* cited by examiner

*Primary Examiner*—Shih-Chao Chen
(74) *Attorney, Agent, or Firm*—Finnegan, Henderson, Farabow, Garrett & Dunner, L.L.P.

(57) ABSTRACT

A slot array antenna, consistent with the invention can include a power feeding waveguide for feeding microwave power and a plurality of rectangular radiating waveguides. The plurality of rectangular radiating waveguides are connected to a plurality of windows which are disposed along the longitudinal direction of the power feeding waveguide so as to guide the microwave power from the plurality of windows to the outside of the antenna. In each of the radiating waveguides, the interval "d" between the centers of gravity of slot pairs or slots is substantially the same as the wavelength λm of the microwave in the rectangular radiating waveguide. A slot array antenna of the present invention can be used in a plasma processing apparatus to increase the plasma density in the plasma-processing chamber.

31 Claims, 5 Drawing Sheets

Prior Art

SLOT ARRAY ANTENNA AND PLASMA PROCESSING APPARATUS

BACKGROUND OF THE INVENTION

1. Field of the Invention

The present invention relates to a slot array antenna and a plasma processing apparatus using the same. The slot array antenna or the plasma processing apparatus according to the present invention is suitably applicable, in particular, to a plasma processing apparatus using a rectangular-type antenna (e.g., a plasma processing apparatus to be used for manufacturing liquid crystal devices).

2. Related Background Art

The slot array antenna and plasma processing apparatus according to the present invention is generally applicable to general plasma processing procedures, including the production of materials for electronic devices such as semiconductors or semiconductor devices, and liquid crystal devices. For the convenience of explanation, however, only the background art relating to liquid crystal devices will be described here.

In general, the process for manufacturing liquid crystal devices involves subjecting a base material (such as wafer) to various kinds of treatments such as CVD (chemical vapor deposition), etching, and sputtering. A plasma processing apparatus has often been used for conducting such treatments. This is because, when a plasma processing apparatus is used, a substrate can be processed if the substrate is maintained at a low temperature.

(Patent Document 1)

JP-A (Japanese Unexamined Patent Publication) No. 2000-123997

The above-mentioned JP-A No. 2000-123997 (Patent Document 1) discloses a plasma processing apparatus, which may be used for manufacturing liquid crystal devices. In such a plasma processing apparatus, use of a slot array antenna is considered to be very promising and highly efficient antenna having a small transmission loss. Particularly promising is an apparatus having a single layer structure (wherein a power feeding waveguide is disposed in the same plane as a radiating waveguide) capable of permitting easy formation of an antenna structure, wherein power is supplied to the radiating waveguide via a window provided in the wall of the power feeding waveguide.

However, according to the present inventors' experiments, it has been found that, when using a conventional plasma processing apparatus having the above-mentioned structure, it is difficult to increase the plasma density in the plasma processing chamber.

SUMMARY OF THE INVENTION

The present invention provides an antenna and a plasma processing apparatus, which overcomes the above-mentioned problem encountered in the prior art.

The present invention also provides an antenna and a plasma processing apparatus, which can easily increase the plasma density in a plasma-processing chamber.

The present inventors have found that the conventional close or dense arrangement of slots in a radiating waveguide (i.e., at intervals which are sufficiently smaller than the wavelength of microwave) in order to obtain an exponential attenuation of electromagnetic field, may provide a disadvantage, especially when a material having a relatively large dielectric constant (e.g., one having a dielectric constant of 4 or more) is used in the radiating waveguide. The present inventors have further found it extremely effective in attaining the above object to constitute a radiating waveguide such that the slot interval "d" in the radiating waveguide is substantially the same as the wavelength λm of above-mentioned microwave in the radiating waveguide.

A plasma processing apparatus consistent with the present invention comprises a power feeding waveguide for feeding microwave power. The plasma processing apparatus further comprises a plurality of rectangular radiating waveguides connected to a plurality of windows which are disposed along the longitudinal direction of the power feeding waveguide. The plurality of windows are disposed so as to guide the microwave power from the plurality of windows to the outside of the antenna. Each of the radiating waveguides has a plurality of slots disposed along the longitudinal direction of the radiating waveguide. The interval "d" between the centers of gravity of slot pairs or slots is substantially the same as the wavelength λm of the microwave in the rectangular radiating waveguide.

The present invention may also provide a plasma processing apparatus comprising a plasma processing chamber for subjecting an object to a plasma treatment. The present invention may also provide an antenna for guiding microwave power into the plasma processing chamber so as to generate plasma in the plasma processing chamber. The antenna comprises a power feeding waveguide for feeding microwave power and a plurality of rectangular radiating waveguides connected to a plurality of windows. The plurality of windows are disposed alone the longitudinal direction of the power feeding waveguide, so as to guide the microwave power from the plurality of windows to the outside of the antenna. Each of the radiating waveguides has a plurality of slots disposed alone the longitudinal direction of the radiating waveguide. The interval "d" between the centers of gravity of slot pairs or slots is substantially the same as the wavelength λm of the microwave in the rectangular radiating waveguide.

DETAILED DESCRIPTION OF PREFERRED EMBODIMENTS

Hereinbelow, the present invention will be described in detail with reference to the accompanying drawings, as desired. In the following description, "%" and "part(s)" representing a quantitative proportion or ratio are those based on mass, unless otherwise noted specifically.

The slot array antenna according to the present invention comprises: a power-feeding waveguide for feeding microwave power; and a plurality of radiating waveguides connected to a plurality of windows which are disposed along the longitudinal direction of the power-feeding waveguide so as to guide the microwave power from the plurality of windows to a plasma processing chamber. The plurality of radiating waveguides are generally disposed so that their longitudinal directions are substantially perpendicular to the longitudinal direction of the power-feeding waveguide. The present invention is characterized in that each of the above-mentioned radiating waveguides has a plurality of slots arranged along the longitudinal direction of the radiating waveguide, and the interval "d" between the plurality of slots is substantially the same as the wavelength λm of the above-mentioned microwave.

As mentioned previously however, when slots are arranged closely or densely (i.e., at intervals which are sufficiently smaller than the wavelength of microwave) in a radiating waveguide in order to obtain an exponential attenuation of electromagnetic field, such a structure may provide a disadvantage, especially when a material having a relatively large dielectric constant is used in the radiating waveguide.

(One Embodiment of Slot Array Antenna)

Figure 1:
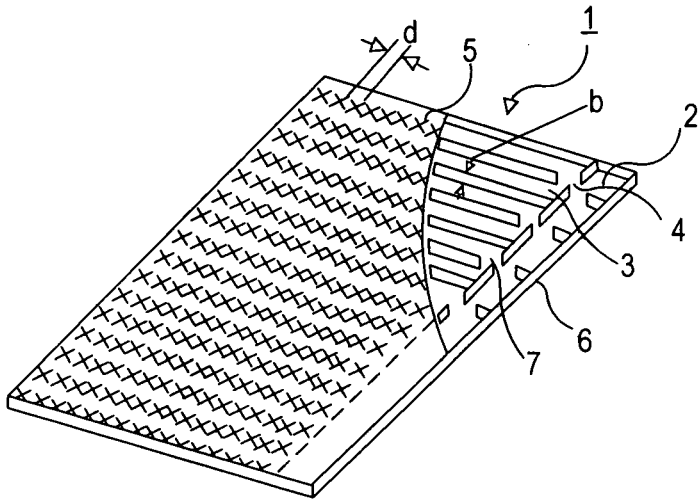
FIG. 1 is a schematic perspective view (with a partially cut-away view) showing an antenna member according to a preferred embodiment of the present invention.

FIG. 1 is a schematic perspective view (with a partially cutaway view showing the internal structure) showing a slot array antenna according to a preferred embodiment of the present invention.

Referring to FIG. 1, antenna 1 in this embodiment comprises a power-feeding waveguide 2 for feeding microwave power, and a plurality of radiating waveguides 3 having a height "b". These radiating waveguides 3 are connected to a plurality of windows 4 which are disposed along the longitudinal direction of the power-feeding waveguide 2 so as to guide the microwave power from the plurality of windows 4 to the outside of antenna 1 (e.g., into an unseen plasma processing chamber).

Each of the radiating waveguides 3 has a plurality of slots 5 disposed along the longitudinal direction of the radiating waveguides 3, and the interval "d" between the plurality of slots 5 is set to a value which is substantially the same as the wavelength λm of the above-mentioned microwave. In FIG. 1, although each of the plurality of slots 5 has the shape of "X", the shape of each slot is not particularly limited as described hereinbelow.

In the present invention, the interval "d" between the plurality of slots 5 is substantially the same as the wavelength λm of the above-mentioned microwave. More specifically, the ratio of the interval "d" between the plurality of slots 5 to the wavelength λm of the above-mentioned microwave, (d/λm), may preferably be in the range of 0.75–1.25, or more preferably in the range of 0.9–1.1.

In the present invention wherein such a structure of slots is adopted, even if a material having a relatively large dielectric constant is used in the inside of antenna means, it becomes easy to substantially suppress the attenuation of the electromagnetic field in the plasma processing chanter so that the plasma density in the plasma processing chamber may be maintained at a high level. According to the present inventors' investigation, maintenance of the plasma density at a high level may presumably be a phenomenon caused by the attenuation characteristic of the radiated electromagnetic field not being represented by an exponential function, but by (1/Z) (wherein Z is the distance from the antenna in the direction perpendicular to the antenna).

Further referring to FIG. 1, side wall members 6 (in this Figure, in the form of plate-like members) are disposed at the respective positions corresponding to the windows 4 along the longitudinal direction of the power-feeding waveguide 2. When the side wall members 6 are located in this manner, it is possible to obtain an advantage that the impedance matching in the power-feeding waveguide can be achieved so as to improve the transmission efficiency.

Further, in FIG. 1, there is adopted a power-feeding system (sometimes, also referred to as "π-branching") in which a cut-out portion 7 is provided in each wall 6 between two radiating waveguides 3 so as to feed the microwave power to the two radiating waveguides 3 from a single window 4 (with respect to the details of "π-branching", for example, a paper written by Takahashi, Hirokawa, Ando, and Goto may be referred to). When such a power-feeding system is adopted, it becomes easy to feed the microwave power to the respective radiating waveguides 3 in an "in-phase" manner.

(Connecting Portion)

Figure 2:
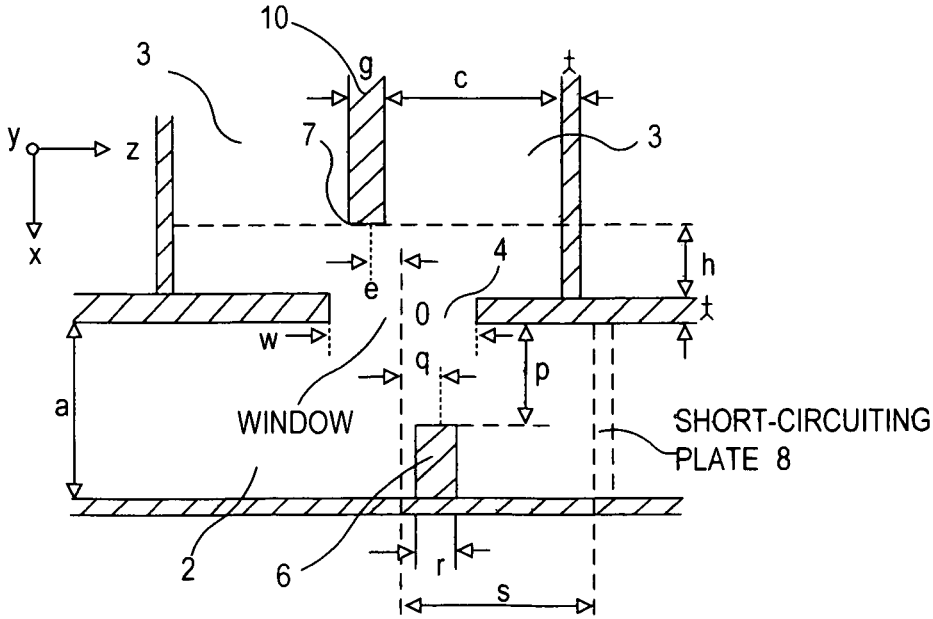
FIG. 2 is a schematic sectional view showing a preferred example of the structure of the connecting portion between a power feeding waveguide and a radiating waveguide of the antenna member as shown in FIG. 1.

FIG. 2 is a schematic partial sectional view showing the detailed structure of a preferred example of the connecting portion between a power feeding waveguide 2 and a radiating waveguide 3.

Referring to FIG. 2, a sidewall member 6 is disposed at the position of the wall of the power-feeding waveguide 2, which is disposed opposite to the window 4 provided in the wall of the power-feeding waveguide 2. Two radiating waveguides 3 are disposed at the position corresponding to the window 4 such that the longitudinal direction of the radiating waveguides 3 is substantially perpendicular to the longitudinal direction of the power-feeding waveguide 2. In the vicinity of the connecting portion (matching element), between the radiating waveguide 3 and the power-feeding waveguide 2 at the terminal end of the power-feeding circuit, a short-circuiting member 8 is provided as shown in FIG. 2. Therefore, it is extremely preferred to design the connecting portion between the power-feeding waveguide 2 and the radiating waveguide 3 in such a terminal end in consideration of a higher mode with respect to the window 4 and the short-circuiting member 8.

As shown in FIG. 2, the power-feeding waveguide 2, two radiating waveguides 3, and the side wall member 6 are electromatically coupled to each other via the window 4 provided in the power-feeding waveguide 2 and the cut-out portion 7. The width of the power-feeding waveguide 2 is denoted by "a", the width of the radiating waveguide 3 is denoted by "c", and the height of these waveguides is denoted by "b" (illustrated in FIG. 1). The width of the coupling window 4 is denoted by "w", and the center of the window 4 is shifted from the center of the cut-out portion 7 by "e". The thickness of the common wall 10 interposed between the two radiating waveguides 3 is denoted by "g", and the distance of the wall 10 from the window 4 is denoted by "h". The side wall member 6 is located at the position corresponding to x=p and z=q in the xyz-coordinate system as shown in FIG. 2 where the origin is represented by O, and the thickness thereof is denoted by "r". The wall thickness of the power-feeding waveguide 2 and the radiating waveguide 3 is denoted by "t". The structure shown in FIG. 2 is uniform in the y-direction.

In the structure as shown in FIG. 2, a preferred structure is as follows:

(1) Width w of the Coupling Window 4:

The width w is monotonically increased along the longitudinal direction of the power-feeding waveguide 2 from the power-feeding side toward the distal end. The mode of this increase may more preferably be monotone.

(2) Position h of the Cutout Portion 7:

The position h is monotonically increased along the longitudinal direction of the power feeding waveguide 2 from the power-feeding side toward the distal end. The mode of this increase may more preferably be monotone.

(3) x-coordinate p of the Sidewall Member 6:

Basically, the value of the x-coordinate p is also changed monotonically, but at the distal end, it becomes a specific value depending upon the combination structure so as to provide good impedance matching.

(4) z-coordinate q of the Sidewall Member 6:

Basically, the value of the z-coordinate q is also changed monotonically, but at the distal end, it becomes a specific value depending upon the combination structure so as to provide a good impedance matching.

(Examples of Preferred Structure)

Preferred examples of the values of the above-mentioned various parameters are as follows in Table 1:

| | Center frequency of the microwave | |
|---|---|---|
| Parameter | 11.85 GHz | 2.45 GHz |
| Width "a" of power-feeding waveguide 2 | 17.3 mm | 83.7 mm (80–110 mm) |
| Width "c" of radiating waveguide 3 | 16.5 mm | 79.9 mm (75–100 mm) |
| Wall thickness "t", "g" of waveguide | 2.0 mm | 2.0 mm |
| Height "b" of waveguide | 4.0 mm | 15. mm (10–40 mm) |
| Shift "e" of window | 0.0 mm | 0.0 mm |
| Thickness "r" of Sidewall member | 2.0 mm | 2.0 mm |

(Conventional Antenna)

Figure 3:
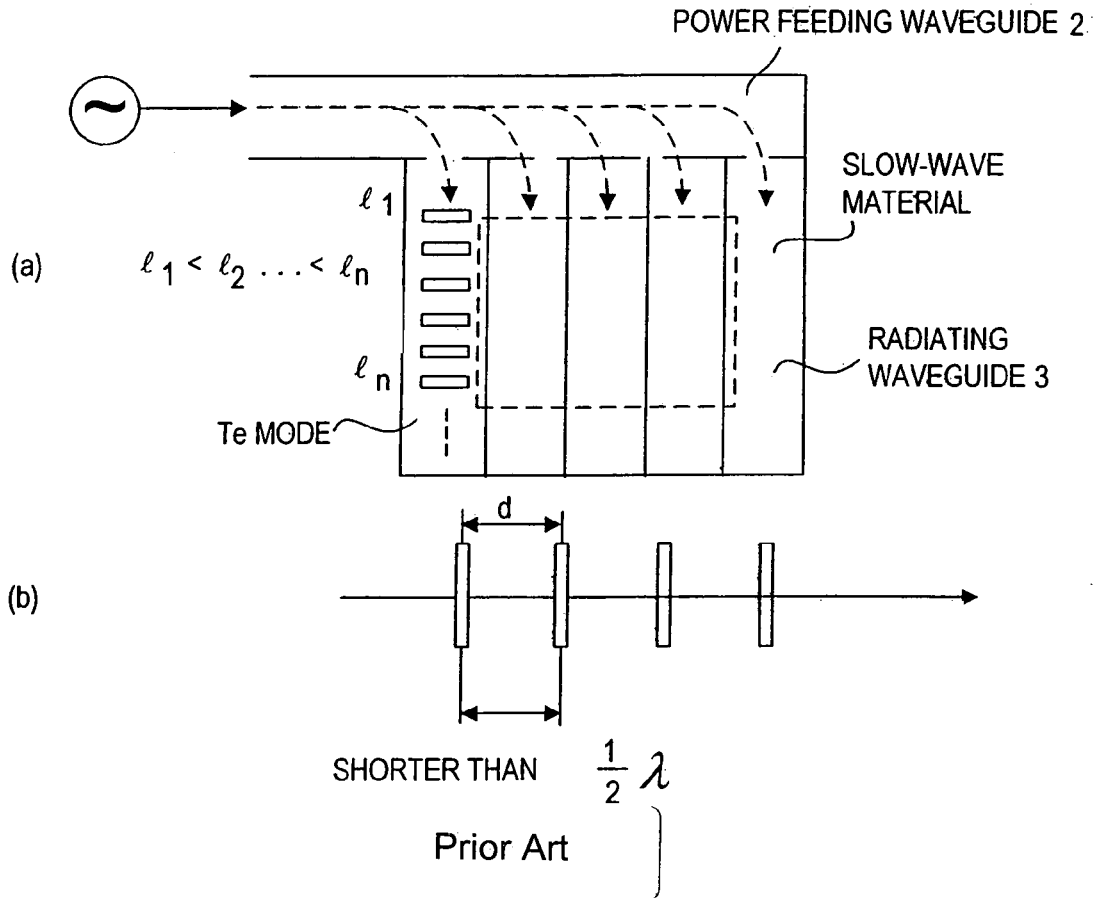
FIG. 3 is a schematic sectional view showing an example of a conventional antenna member.

For the purpose of comparison, a conventional slot array antenna is schematically shown in FIG. 3. Referring to FIG. 3, the slots constituting a radiating waveguide 3 are constructed such that the width l thereof satisfies a relationship of $l_1<l_2<\ldots l_n$, as shown in FIG. 3(*a*), and the interval between these slots is smaller than (½)λ (where λ is the wavelength of the microwave in the waveguide), as shown in FIG. 3(*b*). In such a conventional slot array antenna, the microwave power is radiated from the radiating waveguide 3 to the outside of the antenna such that the strength of the electromagnetic field is exponentially attenuated.

(Plasma Processing Apparatus)

The plasma processing apparatus according to the present invention is one comprising a plasma processing chamber for subjecting an object to be processed to a plasma treatment; and antenna means for guiding microwave power into the plasma processing chamber so as to generate plasma in the plasma processing chamber. In this apparatus, the antenna means is a slot array antenna (according to the present invention) having a structure as described hereinabove.

(One Embodiment of a Plasma Processing Apparatus)

Figure 4:
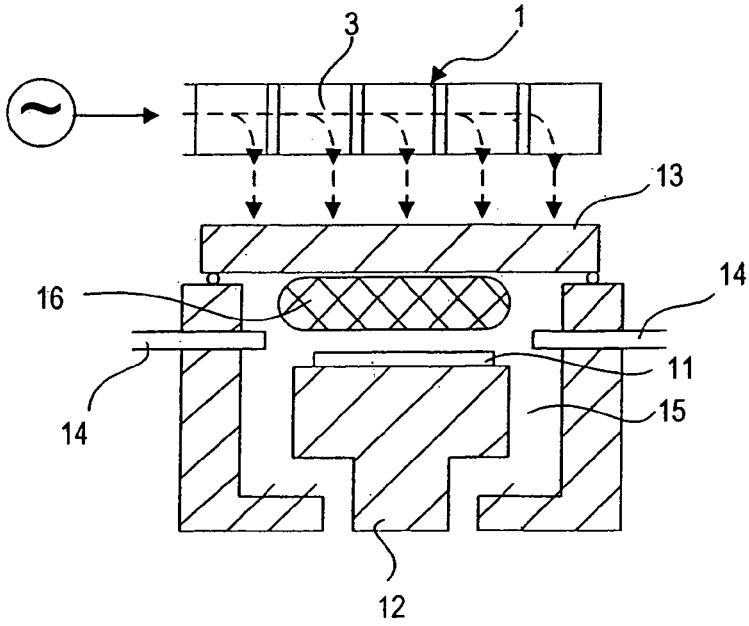
Prior Art Fig. 4
FIG. 4 is a schematic sectional view showing a plasma processing apparatus according to a preferred embodiment of the present invention.

FIG. 4 is a schematic sectional view showing the plasma processing apparatus according to a preferred embodiment of the present invention. Referring now to FIG. 4, in a plasma-processing chamber 15 constructed as a closed container, there is provided a processing stage 12 for placing an object 11 to be processed such as a glass substrate. On the ceiling portion of the plasma-processing chamber 15, a microwave inlet window 13 formed of a dielectric material such as quartz and ceramic is disposed. Further, a gas supplying port 14 is provided in the plasma-processing chamber 15 for supplying a reactant gas into the plasma-processing chamber 15.

On the top portion of the plasma processing chamber 15, a slot array antenna member 1 having the above-described structure is disposed such that the microwave is fed from the radiating waveguide 3 constituting the antenna member 1 into the plasma processing chamber 15 so as to generate plasma in a plasma generating region 16 in the plasma processing chamber 15 to thereby process the object 11 using to a predetermined plasma treatment.

(Constitution of Various Components)

Hereinbelow, the structure of various components constituting the antenna and the plasma processing apparatus shown in FIGS. 1, 2 and 4 will be described in detail.

(Power-feeding Waveguide)

The shape, size, structure, etc., of the power-feeding waveguide 2 are not particularly limited, but the power-feeding waveguide 2 may preferably be a rectangular waveguide. This is because, in an embodiment using such a rectangular waveguide, it is quite easy to reduce the cost by using a single microwave power supply.

Material of Waveguide

Material for the power-feeding waveguide 2, the radiating waveguide 3 and other members constituting the above-described antenna are not particularly limited, as long as microwave power can be supplied by using such antenna. In view of the reduction in the loss due to wall current and of the thermal conductivity, however, the material for these members may preferably be one comprising a copper base material with a silver plating.

(Dielectric Material for the Radiating Waveguide 3)

The dielectric material for constituting the radiating waveguide 3 is not particularly limited. In view of the ratio of the wavelength of the microwave and the chamber size (L/λm), this material may preferably be one having a dielectric constant which is not less than λ/5L (λ is the wavelength the microwave in vacuum, and L is the chamber size).

(Variable Coupling Window)

In the connecting portion (i.e., power-feeding portion) between the power-feeding waveguide 2 and the radiating waveguide 3 shown in FIG. 2, a coupling window having a variable width w may be provided, as desired. In an embodiment wherein such a variable coupling window is provided, it is possible to obtain an advantage that the distribution of the radiated electromagnetic field in the chamber can be adjusted and hence the distribution of the generated plasma can also be adjusted.

In addition, it is also possible that a "rod-shaped" member can be erected in the power-feeding portion of the radiating waveguide 3 so as to adjust the L component, to thereby achieve good load matching. In an embodiment wherein such a rod-shaped member is provided, the side wall plate 6 in the power-feeding waveguide 2 becomes omissible so that the related structure can be advantageously simplified thereby.

(Slots)

In the embodiment shown in FIG. 1, the slots in the radiating waveguide 3 are in the shape of an "X", but the shape of the matching slot used herein is not particularly limited, as long as the traveling or progressive wave can be substantially erased (i.e., the reflected wave can be substantially eliminated).

Figure 5:
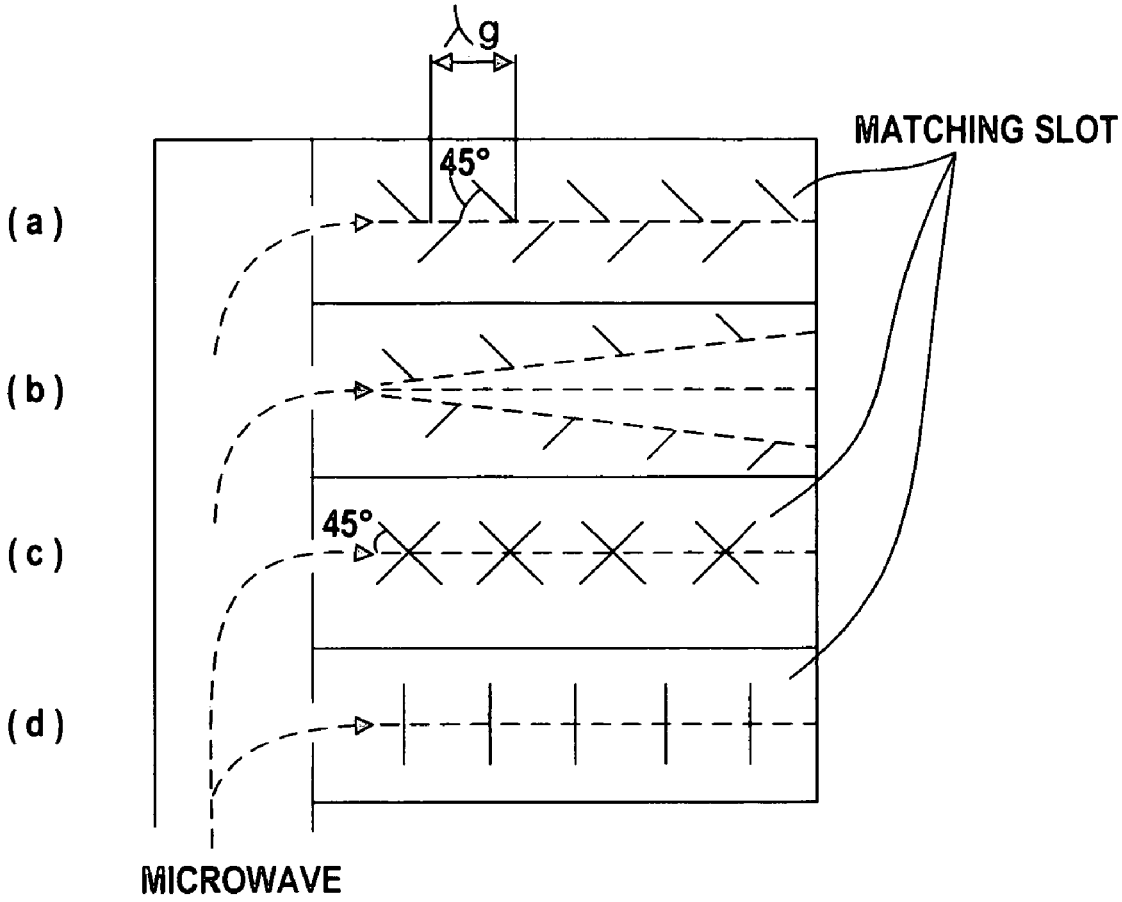
FIG. 5 is a schematic plan view showing an example of the shape of slots and matching slots (disposed at the terminal portion of each radiating waveguide), which is usable in the antenna member according to the present invention.

In other words, the shape of the slots may be of any known shapes. For example, the slots of any shape shown in the schematic plan view of FIG. 5 may be used. FIG. 5 is depicted so that the respective radiating waveguides 3 have slots of different shapes, but this figure is only for the convenience of explanation. In an actual antenna, the respective radiating waveguides 3 constituting the antenna have the same slot shapes.

For example, the shape of the slot may be a staggered Λ(lambda)-shape along the center line as shown in the schematic plan view (a) of FIG. 5, or it may be a staggered Λ-shape as shown in FIG. 5(*b*) in which the centerline diverges toward the distal end, or it may be an X-shape along the center line as shown in FIG. 5(*c*), or it may be a linear shape along the centerline as shown in FIG. 5(*d*).

In the case of a staggered Λ-shape as shown in FIG. 5(*a*), the interval between the staggered Λ-shaped slots is substantially equal to λg, and the angle of the Λ-shape is 45°.

In the case of the staggered Λ-shape as shown in FIG. 5(*b*), the slots are disposed in such a manner that they gradually deviate from the center axis of the radiating waveguide 3, and the reflected power in the terminal end can easily be suppressed. This is because the reflection of power is gradually suppressed by each of the gradually deviating slots. Even in the embodiment shown in FIG. 5(*b*), it is preferred to provide a matching slot suitable for a terminal end, at the terminal end.

Also in the case of the X-shaped slots as shown in FIG. 5(*c*), the interval between the X-shaped slots may be substantially λg, and the angle of the X-shaped slots may be about 45°.

(Angle)

The angle of inclination of each slot relative to the center axis of the radiating waveguide may preferably be about 45°. When the angle θ in the staggered Λ-shaped slots is greater than 45°, the electromagnetic field tends to be radiated more strongly towards the power feeding side. When the angle θ is less than 45°, the electromagnetic field tends to be radiated more strongly towards the terminal end. Accordingly, it is possible to generate plasma due to "oblique propagation" by adjusting the angle θ.

When an individual slot in each pair is made shorter than the other slot of the pair, the electromagnetic field tends to be radiated more strongly towards the shorter slot. Accordingly, the "oblique propagation" can also be achieved by utilizing such characteristics.

(Standing Wave and Traveling Wave)

Figure 6:
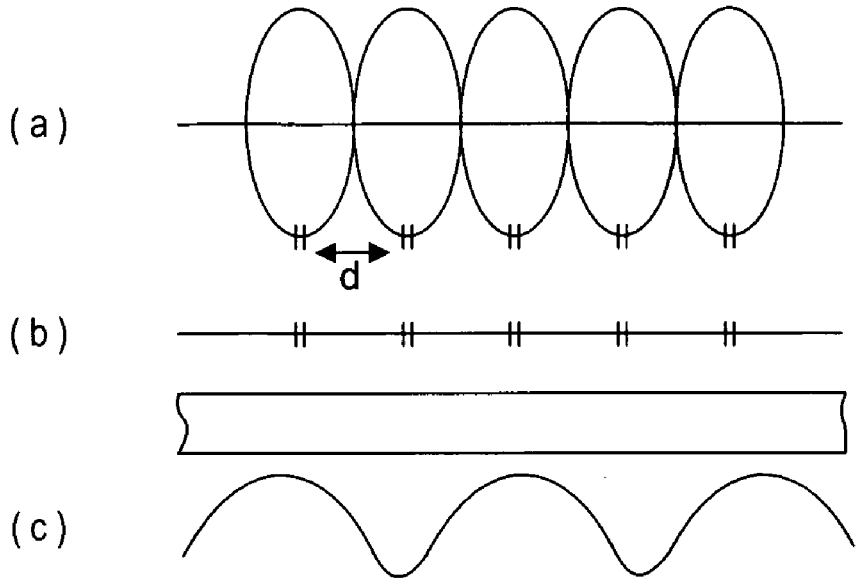
FIG. 6 is a graph schematically showing (a) the shape of a standing wave provided by an antenna member according to the present invention, (b) the position of slots corresponding to the shape of the standing wave, and (c) the plasma intensity corresponding to the shape of the standing wave.

When the microwave in the radiating waveguide 3 is a standing (or stationary) wave as shown in FIG. 6(*a*), the slots corresponding thereto are those as shown in FIG. 6(*b*). Accordingly, in this case, the plasma intensity directly under the slots is necessarily non-uniform along the longitudinal direction of the radiating waveguide 3, as shown in FIG. 6(*c*). Therefore, when a standing wave is to be used, it is necessary to provide a space between the radiating waveguide 3 and a object 11 to be processed so as to make uniform the plasma intensity. The size of the apparatus also tends to be increased.

In this respect, it is preferred that a traveling wave be formed along the longitudinal direction of the radiating waveguide 3. This is because, when a standing wave is formed, as described above, the plasma intensity directly under the slots of the radiating waveguide 3 tends to become non-uniform along the longitudinal direction of the radiating waveguide 3.

Figure 7:
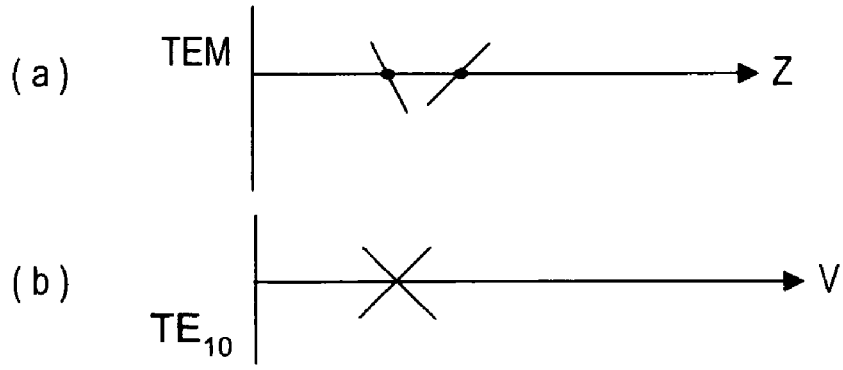
FIG. 7 is a graph schematically showing the electric field strength of (a) TE01 mode in a staggered Λ-shaped slot, and (b) TE10 mode in an X-shaped slot, which can be provided by an antenna member according to the present invention.

In this respect, in the case of the staggered Λ-shaped slots as shown in FIG. 7(*a*), a circularly polarized wave is radiated in TE10 mode (in a strict sense, in TEM mode) as shown in this figure. When the angle θ in the staggered Λ-shaped slots is increased, the electromagnetic field tends to be radiated more strongly towards the power feeding side. When the angle θ is decreased, the electromagnetic field tends to be radiated more strongly towards the terminal end. Accordingly, it is possible to generate plasma by "oblique propagation" by adjusting the angle θ.

On the other hand, in the case of the X-shaped slots as shown in FIG. 7(*b*). a linearly polarized wave is radiated in TEM mode as shown in this figure. It is also possible to radiate a circularly polarized wave by adjusting the ratio of the length of respective slots or the angle relative to the centerline of the waveguide.

(Sidewall Members)

In view of the impedance matching, etc., a sidewall member 6 in the form of an "adjusting pin" may be used in place of the "plate-shaped" member shown in FIG. 2. Such an "adjusting pin" (not shown) may preferably be disposed in the vicinity of the tip of the "side wall plate" shown in FIG. 2.

(Terminal End Portion)

At the terminal end of the radiating waveguide 3, a matching slot for suppressing the reflected power from the terminal end may be provided, as desired. When a matching slot is provided at the terminal end, it is possible to obtain an advantage that the traveling wave can be obtained (the reflected wave can be suppressed) in the waveguide.

(Other Embodiments of Antenna)

The radiating waveguide 31 may be provided in one-to-one correspondence with the windows 41 in the power-feeding waveguide 21. An example of this embodiment is shown in FIG. 8.

Figure 8:
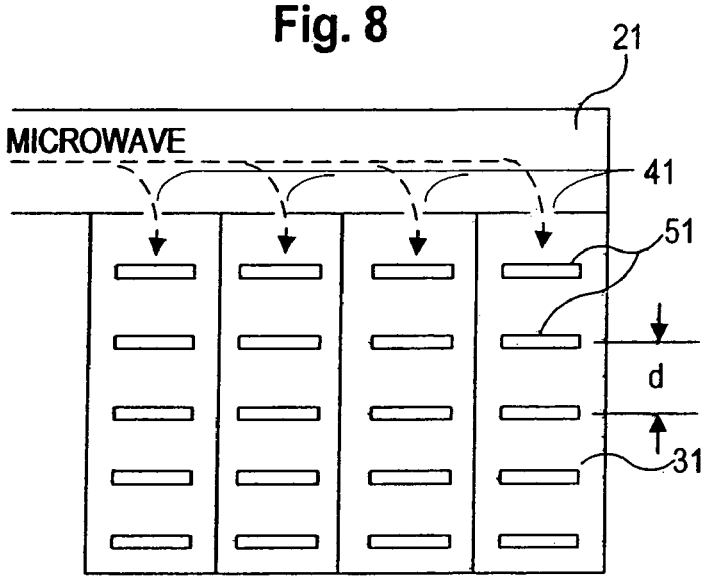
FIG. 8 is a schematic sectional view showing an antenna member according to another preferred embodiment of the present invention.

FIG. 8 is a schematic plan view showing an embodiment of an antenna member, which is advantageously usable in the plasma processing apparatus according to the present invention. For comparison, a schematic plan view of a conventional slot array antenna is shown in FIG. 9.

Referring to FIG. 8, the antenna means in this embodiment comprises a power feeding waveguide 23 for feeding microwave power, and a plurality of radiating waveguides 31 connected to a plurality of windows 41 which are disposed along the longitudinal direction of the power feeding waveguide 21 so as to guide the microwave from the windows 41 into a plasma processing chamber. Each of these radiating waveguides 31 has a plurality of slots 51 disposed along the longitudinal direction of the radiating waveguide 31. Further, the interval "d" between the plurality of slots is substantially the same as the wavelength λm of the microwave. The interval "d" of the plurality of slots may preferably be in the range of $0.75<d/\lambda m \leqq 1.25$ more preferably in the range of $0.9<d/\lambda m <1.1$, with respect to the wavelength λm of the above-mentioned microwave.

In the present invention, the slots having such a structure is adopted, and therefore, it becomes easy to suppress the attenuation of the electromagnetic field introduced to the plasma processing chamber, even when material having a relatively large dielectric constant is used in the antenna means. As a result, it becomes easy to maintain the plasma density at a high level in the plasma-processing chamber.

Figure 9:
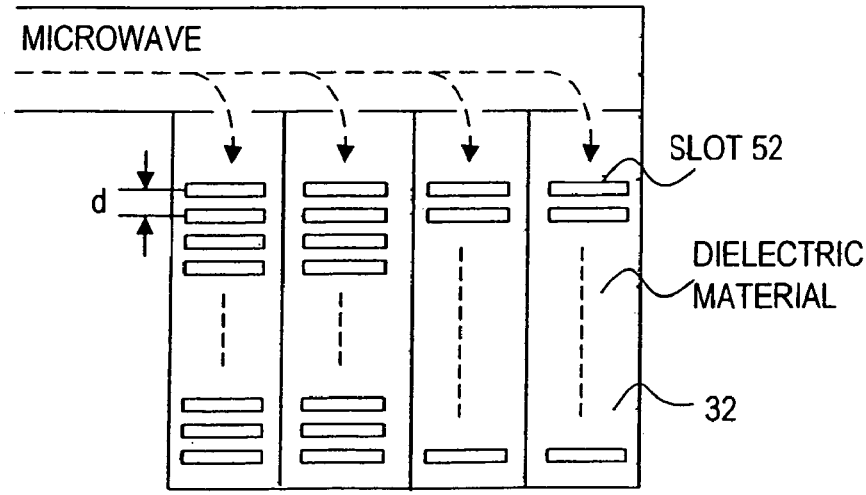
FIG. 9 is a schematic sectional view showing an example of the antenna member in the prior art.

On the contrary, in the conventional slot array antenna as shown in FIG. 9, the slots 52 are closely arranged (i.e., at an interval d which is substantially smaller than the wavelength of the microwave) in the radiation waveguide 32 so as to provide an exponential attenuation of the electromagnetic field. Accordingly, especially when a material having a relatively large dielectric constant is used in the radiating waveguide 32 this arrangement of slots 52 functions unfavorably. Accordingly, when a slot array antenna of the conventional type as shown in FIG. 9 is used, it is difficult to maintain the plasma density at a high level in the plasma-processing chamber.

(Other Examples of Application)

The application or use of the antenna or the plasma processing apparatus according to the present invention is not particularly limited. In other words, the antenna or the plasma processing apparatus according to the present invention may be applied to any apparatus utilizing plasma such as, for example, a plasma etching apparatus, plasma CVD apparatus, or plasma LCD apparatus.

As described hereinabove, the present invention can provide a plasma processing apparatus wherein the plasma density can easily be enhanced.

What is claimed is:

1. A slot array antenna, comprising:

a power-feeding waveguide for feeding microwave power; and a plurality of rectangular radiating waveguides connected to a plurality of windows which are disposed along the longitudinal direction of the power-feeding waveguide, so as to guide the microwave cower from the plurality of windows to the outside of the antenna;

wherein each of the radiating waveguides has a plurality of slots disposed along the longitudinal direction of the radiating waveguide; the interval "d" between adjacent slots is substantially the same as the wavelength λm of the microwave in the rectangular radiating waveguide; and the slots formed on one side of the radiating waveguide are disposed such that they gradually deviate from the center axis in the longitudinal direction of the radiating waveguide.

2. A slot array antenna according to claim 1, wherein the slots provided on one side of the radiating waveguide are such that they form an inclination angle of 45° relative to the center axis in the longitudinal direction of the radiating waveguide.

3. A slot array antenna according to claim 1, wherein the dielectric constant of a dielectric material disposed in the radiating waveguide is 1 or more.

4. A slot array antenna according to claim 1, wherein the power-feeding waveguide is a rectangular waveguide.

5. A slot array antenna according to claim 1, wherein a traveling wave is to be generated in the radiating waveguide.

6. A slot array antenna according to claim 1, wherein a matching slot is disposed at the terminal end of the radiating waveguide.

7. A slot array antenna according to claim 1, wherein the slots formed on one side of the radiating waveguide are selected from the group consisting of: slots perpendicular to the traveling direction of the electromagnetic field, slot pairs in the form of "staggered Λ", and slot pairs each of which is inclined at about 45° with respect to the traveling direction of the electromagnetic field.

8. A slot array antenna, comprising:

a power-feeding waveguide for feeding microwave power; and a plurality of rectangular radiating waveguides connected to a plurality of windows which are disposed alone the longitudinal direction of the power-feeding waveguide, so as to guide the microwave power from the plurality of windows to the outside of the antenna;

wherein each of the radiating waveguides has a plurality of slots disposed along the longitudinal direction of the radiating waveguide; the interval "d" between the adjacent slots is substantially the same as the wavelength λm of the microwave in the rectangular radiating waveguide; and a coupling window having a variable width is disposed at the power-feeding portions for feeding power from the power-feeding waveguide to the radiating waveguide.

9. A slot array antenna according to claim 8, wherein the dielectric constant of a dielectric material disposed in the radiating waveguide is 1 or more.

10. A slot array antenna according to claim 8, wherein the power-feeding waveguide is a rectangular waveguide.

11. A slot array antenna according to claim 8, wherein a traveling wave is to be generated in the radiating waveguide.

12. A slot array antenna according to claim 8, wherein a matching slot is disposed at the terminal end of the radiating waveguide.

13. A slot array antenna according to claim 8, wherein the slots provided on one side of the radiating waveguide are such that they form an inclination angle of 45 relative to the center axis in the longitudinal direction of the radiating waveguide.

14. A slot array antenna according to claim 8, wherein the slots formed on one side of the radiating waveguide are selected from the group consisting of: slots perpendicular to the traveling direction of the electromagnetic field, slot pairs in the form of "staggered Λ," and slot pairs each of which is inclined at about 45 with respect to the traveling direction of the electromagnetic field.

15. A slot array antenna according to claim 8, wherein the slots formed on one side of the radiating waveguide are disposed such that they gradually deviate from the center axis in the longitudinal direction of the radiating waveguide.

16. A plasma processing apparatus comprising:

a plasma processing chamber for subjecting an object to a plasma treatment; and antenna means for guiding microwave power into the plasma processing chamber so as to generate plasma in the plasma processing chamber;

wherein the antenna means comprises: a power-feeding waveguide for feeding microwave power; and a plurality of rectangular radiating waveguides connected to a plurality of windows which are disposed along the longitudinal direction of the power-feeding waveguide, so as to guide the microwave power from the plurality of windows to the outside of the antenna, wherein each of the radiating waveguides has a plurality of slots disposed along the longitudinal direction of the radiating waveguide; and the interval "d" between adjacent slots is substantially the same as the wavelength λm of the microwave in the rectangular radiating waveguide; and the slots formed on one side of the radiating waveguide are disposed such that they gradually deviate from the center axis in the longitudinal direction of the radiating waveguide.

17. A plasma processing apparatus according to claim 16, wherein the interval "d" between adjacent slots is in the range of $0.75<d/\lambda m<1.25$, with respect to the wavelength $\lambda m$ of the microwave.

18. A plasma processing apparatus according to claim 16, wherein the dielectric constant of a dielectric material disposed in the radiating waveguide is 1 or more.

19. A plasma processing apparatus according to claim 16, wherein the power-feeding waveguide is a rectangular waveguide.

20. A plasma processing apparatus according to claim 16, wherein a traveling wave is to be generated in the radiating waveguide.

21. A plasma processing apparatus according to claim 16, wherein a matching slot is disposed at the terminal end of the radiating waveguide.

22. A plasma processing apparatus according to claim 16, wherein the slots provided on one side of the radiating waveguide are such that they form an inclination angle of 45 relative to the center axis in the longitudinal direction of the radiating waveguide.

23. A plasma processing apparatus according to claim 16, wherein the slots formed on one side of the radiating waveguide are selected from the group consisting of: slots perpendicular to the traveling direction of the electromagnetic field, slot pairs in the form of "staggered Λ," and slot pairs each of which is inclined at about 45 with respect to the traveling direction of the electromagnetic field.

24. A plasma processing apparatus comprising:

a plasma processing chamber for subjecting an object to be processed to a plasma treatment; and antenna means for guiding microwave power into the plasma processing chamber so as to generate plasma in the plasma processing chamber;

wherein the antenna means comprises:

a power-feeding waveguide for feeding microwave power; and a plurality of rectangular radiating waveguides connected to a plurality of windows which are disposed along the longitudinal direction of the power-feeding waveguide, so as to guide the microwave power from the plurality of windows to the outside of the antenna, wherein each of the radiating waveguides has a plurality of slots disposed along the longitudinal direction of the radiating waveguide; and the interval "d" between adjacent slots is substantially the same as the wavelength $\lambda m$ of the microwave in the rectangular radiating waveguide; and a coupling window having a variable width is disposed at the power-feeding portions for feeding power from the power-feeding waveguide to the radiating waveguide.

25. A plasma processing apparatus according to claim 24, wherein the dielectric constant of a dielectric material disposed in the radiating waveguide is 1 or more.

26. A plasma processing apparatus according to claim 24, wherein the power-feeding waveguide is a rectangular waveguide.

27. A plasma processing apparatus according to claim 24, wherein a traveling wave is to be generated in the radiating waveguide.

28. A plasma processing apparatus according to claim 24, wherein a matching slot is disposed at the terminal end of the radiating waveguide.

29. A plasma processing apparatus according to claim 24, wherein the slots provided on one side of the radiating waveguide are such that they form an inclination angle of 45 relative to the center axis in the longitudinal direction of the radiating waveguide.

30. A plasma processing apparatus according to claim 24, wherein the slots formed on one side of the radiating waveguide are selected from the group consisting of: slots perpendicular to the traveling direction of the electromagnetic field, slot pairs in the form of "staggered Λ," and slot pairs each of which is inclined at about 45 with respect to the traveling direction of the electromagnetic field.

31. A plasma processing apparatus according to claim 24, wherein the slots formed on one side of the radiating waveguide are disposed such that they gradually deviate from the center axis in the longitudinal direction of the radiating waveguide.

* * * * *